US008007074B2

(12) United States Patent
Fujii et al.

(10) Patent No.: US 8,007,074 B2
(45) Date of Patent: Aug. 30, 2011

(54) LIQUID DISCHARGE RECORDING HEAD

(75) Inventors: Kenji Fujii, Hiratsuka (JP); Masahisa Watanabe, Yokohama (JP); Shuhei Oya, Oita (JP); Seiko Minami, Warabi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/827,903

(22) Filed: Jun. 30, 2010

(65) Prior Publication Data

US 2010/0321446 A1 Dec. 23, 2010

Related U.S. Application Data

(63) Continuation of application No. PCT/JP2009/061375, filed on Jun. 23, 2009.

(51) Int. Cl.
*B41J 2/14* (2006.01)
*B41J 2/16* (2006.01)

(52) U.S. Cl. ..... 347/47; 347/43; 347/65

(58) Field of Classification Search ..... 347/12, 347/13, 20, 42, 43, 44, 47, 49, 50, 56–59, 347/61–65, 67

See application file for complete search history.

(56) References Cited

U.S. PATENT DOCUMENTS

| | | | | |
|---|---|---|---|---|
| 6,315,390 | B1 * | 11/2001 | Fujii et al. | 347/42 |
| 6,474,790 | B2 * | 11/2002 | Kaneko | 347/59 |
| 7,198,353 | B2 * | 4/2007 | Hart et al. | 347/47 |

FOREIGN PATENT DOCUMENTS

| | | |
|---|---|---|
| JP | 8-281926 | 10/1996 |
| JP | 2000-255057 | 9/2000 |
| JP | 2002-154208 | 5/2002 |
| JP | 2002-321354 | 11/2002 |

* cited by examiner

*Primary Examiner* — Juanita D Stephens
(74) *Attorney, Agent, or Firm* — Canon USA Inc IP Division

(57) ABSTRACT

A liquid discharge recording head comprising a plurality of recording element boards for discharging black ink and color ink, by which image quality of color ink is improved without decreasing image quality of black ink. The liquid discharge recording head including: a first recording element board including a first discharge aperture for discharging liquid; a second recording element board including a second discharge aperture, the second discharge aperture being smaller than the first discharge aperture; and a support member including a face for supporting the first recording element board and the second recording element board. A distance from the face of the support member to the second discharge aperture is longer than a distance from the face of the support member to the first discharge aperture.

9 Claims, 8 Drawing Sheets

LIQUID DISCHARGE RECORDING HEAD

This application is a Continuation of International Application No. PCT/JP2009/061375, filed Jun. 23, 2009, which is hereby incorporated by reference herein in its entirety.

BACKGROUND OF THE INVENTION

1. Field of the Invention

The present invention is related to a liquid discharge recording head for performing a recording operation by discharging liquids, such as ink, from a discharge port. Specifically, it is related to an ink jet recording head for performing recording by discharging ink. The liquid discharge recording head of the present invention can be applied to devices such as a copying machine, a facsimile having a communication system, a word processor having a printing section, and a recording apparatus, which is multi-functionally combined with each device, other than a common printing device. In the present invention, "recording" also means adding an image such as a simple pattern.

2. Description of the Related Art

Japanese Patent Laid-Open No. 2002-154208 discloses a recording head mounted on an ink jet recording apparatus. Japanese Patent Laid-Open No. 2002-154208 discloses a configuration for mounting two recording element boards, having two different discharging methods, on one chip plate (supporting member) so as to achieve high-grade recording as well as high-speed recording, and at the same time, to achieve lower cost and simplifying as well as downsizing of the configuration. Such a configuration is shown in FIG. 6.

FIG. 6 is a sectional view of recording element boards 5 and 6 and support member 3 in the conventional art. FIG. 6 is equivalent to a part of the A-A' section of the liquid discharge recording head of FIG. 8. Japanese Laid-Open No. 2002-154208 discloses that the Si boards 18 and 19, used for the two recording element boards 4 and 5, respectively, have the same thickness. A flow path forming member 20 in recording element board 4 for discharging black ink has a nozzle structure for discharging a large droplet, and for efficiently performing solid printing, by preparing the distance between the energy generating element 2 and the discharge port 11 to be longer. For the discharging method of this nozzle structure, the method of generating an air bubble in ink by driving a recording element and discharging ink by defoaming of the air bubble is adopted. On the other hand, the recording element board 5 for discharging color ink has a nozzle structure for achieving highly-accurate and high-quality recording by discharging a droplet of a small amount, compared to black ink, by shortening a distance between the energy generating element 2 and the discharge port 11, compared to black ink. For the discharge method of this nozzle structure, a method of discharging ink by having an internal pressure of an air bubble communicate with air in a negative state, the air bubble being generated in the ink by driving a recording element is adopted.

A liquid discharge recording head where two recording element boards are mounted on one support member discharges ink in a direction substantially perpendicular to a medium to be recorded in performing recording by being set in a recording apparatus as shown in FIG. 7. Also, there is some undulation on the surface of the medium to be recorded. Therefore a gap of approximately 1.2 mm is provided between the liquid discharge recording head and the medium to be recorded such that a face of the liquid discharge recording head, on which a discharge port is disposed, and the surface of the medium to be recorded do not interfere. This gap is referred to as head-to-paper distance. The most suitable distance is set for this head-to-paper distance by balancing image quality and cost.

With respect to a head disclosed in Japanese Patent Laid-Open No. 2002-154208, in the recording element board 4 for discharging black ink, the distance between the energy generating element 2 and the discharge port 11 is longer, compared to the recording element board 5, since the recording element board 4 is configured to discharge a larger droplet, compared to the recording element board 5. On the other hand, the recording element board 5 for discharging color ink has a nozzle structure where a distance between the recording element and the discharge port is shorter since the recording element board 5 is configured to discharge a smaller droplet. Thus, when the thickness of the Si substrates 18 and 19 are approximately the same, the distance between the discharge port and the medium to be recorded (head-to-paper distance) is relatively longer in the recording element board 5 for discharging color ink than in the recording element board 4 for discharging black ink. Generally, landing accuracy of discharged ink to a medium to be recorded deteriorates when the head-to-paper distance becomes longer. Therefore, droplet landing accuracy may deteriorate. The deterioration in the droplet landing accuracy of the recording element board 5 for discharging color ink is one of the reasons of color unevenness in so-called secondary color formation, formed by color inks. In the conventional product, the image quality has been improved by increasing the number of times that a recording head scans over a medium to be recorded (the number of passes). However, as demand for improved printing speed increases, the number of passes tends to decrease. At the same time, there is a demand for higher quality of images, and improvement of landing accuracy of a droplet of small amount, such as color ink, becomes more important. The smaller that the amount of the discharged liquid is, the larger the influence of the landing accuracy to a medium to be recorded and a satellite droplet, being generated accompanying a main droplet, becomes. As a result, the influence on image quality becomes more significant.

In view of the above-described problem, there is a need for improvement of image quality of a head for color ink for performing relatively small-amount discharge, without lowering image quality of a head for black ink.

SUMMARY OF THE INVENTION

The present invention improves image quality of a head for color ink for performing relatively small-amount discharge, without lowering image quality of a head for black ink.

According to an exemplary embodiment of the present invention, a liquid discharge recording head includes a first recording element board including a first discharge aperture for discharging liquid, a second recording element board including a second discharge aperture, the second discharge aperture being smaller than the first discharge aperture, and a support member, including a face, for supporting the first recording element board and the second recording element board, in the liquid discharge recording head, a distance from the face of the support member to the second discharge aperture is longer than a distance from the face of the support member to the first discharge aperture.

The present invention improves the landing accuracy of a head for color ink which discharges a droplet of relatively small-amount droplet without lowering of the image quality by a head for black ink. As a result, image quality can be improved.

Other features of the present invention will be apparent from the following description taken in conjunction with the accompanying drawings, in which like reference characters designate the same or similar parts throughout the figures thereof.

DETAILED DESCRIPTION OF EMBODIMENTS

Exemplary embodiments of the present invention are described below with reference to the drawings.

Figure 8:
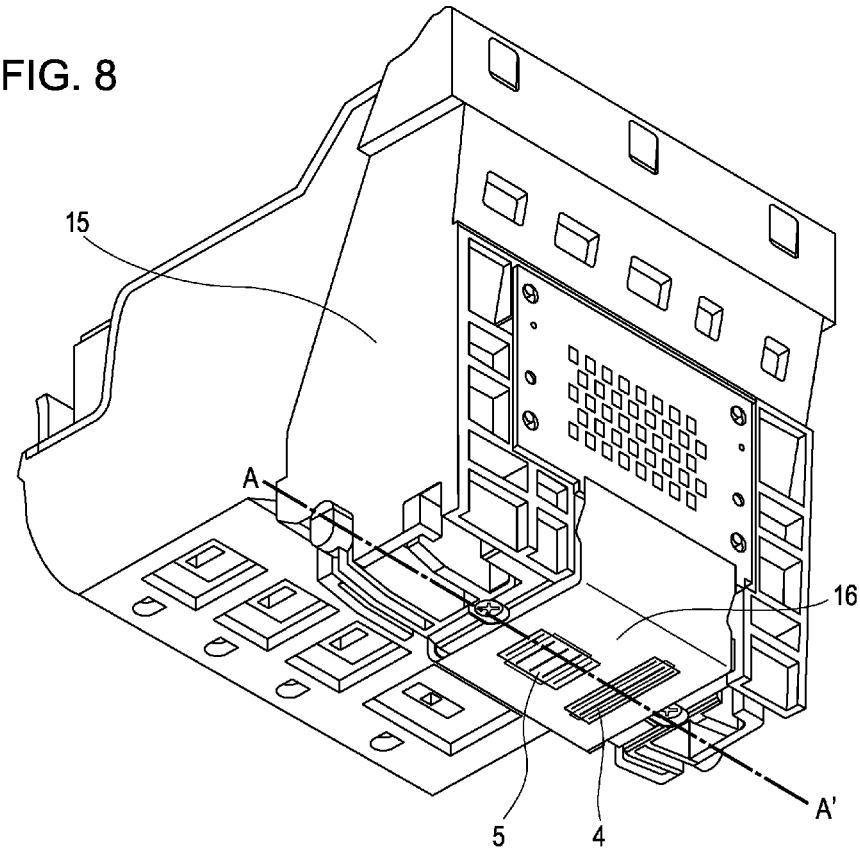
FIG. 8 illustrates an exemplary shape of the liquid discharge recording head.
Figure 9:
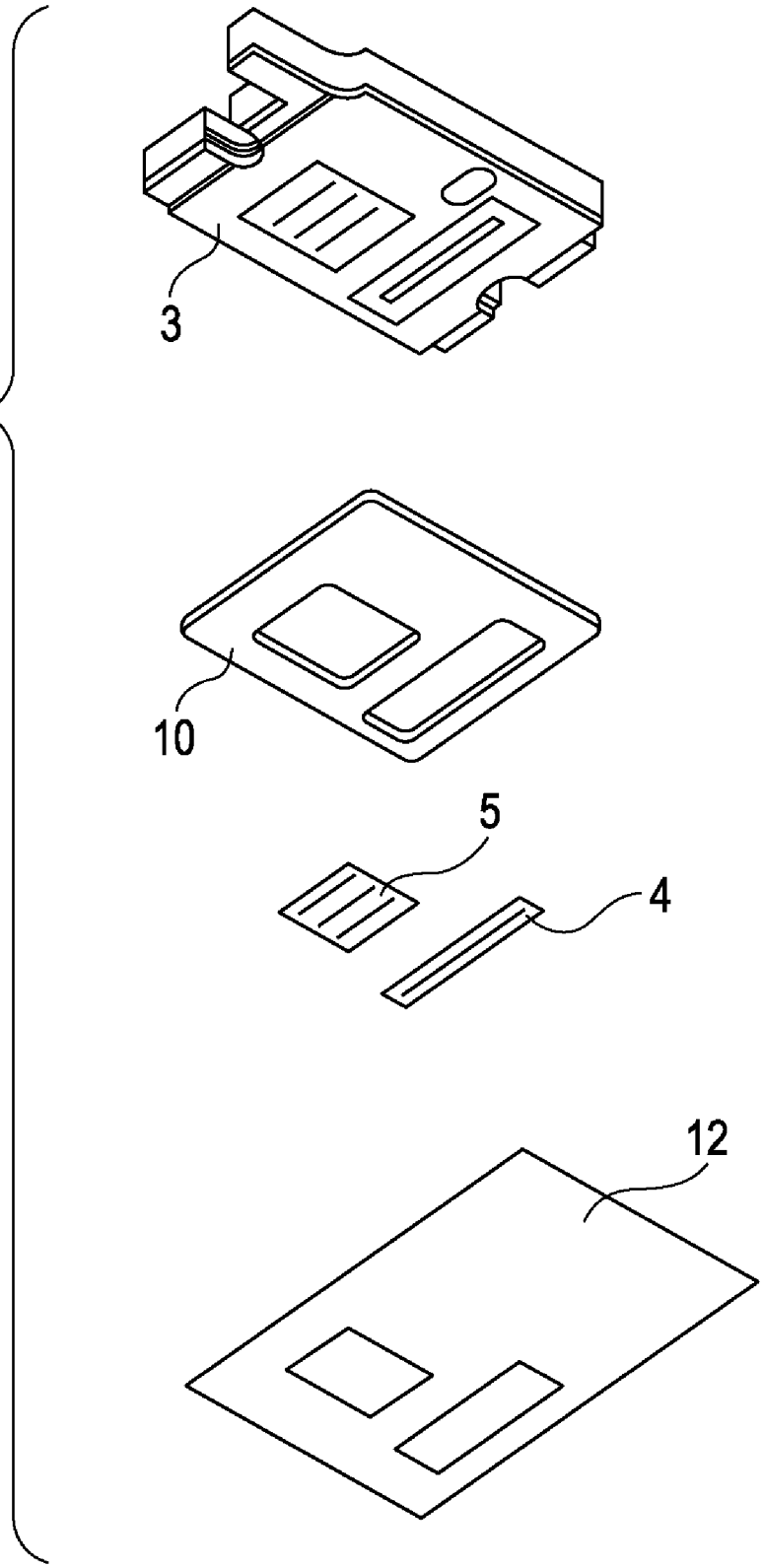
FIG. 9 illustrates essential parts of a recording element unit of the present invention.

FIG. 8 illustrates a liquid discharge recording head. The liquid discharge recording head of the present embodiment includes a recording element unit 16 and liquid supply unit 15. The liquid discharge recording head is set in a recording apparatus so that a surface where the recording element unit 16 is formed opposes a medium on which an image is to be recorded. An exemplary configuration of the recording element unit 16 is shown in FIG. 9. In FIG. 9, a first recording element board 4 and a second recording element board 5 are affixed (e.g., glued) to support member 3. Then, recording element unit 16 is formed by affixing (e.g., gluing) a second support member 10 to support member 3, and attaching electric wiring tape 12 to the second support member 10.

First Embodiment

Figure 1:
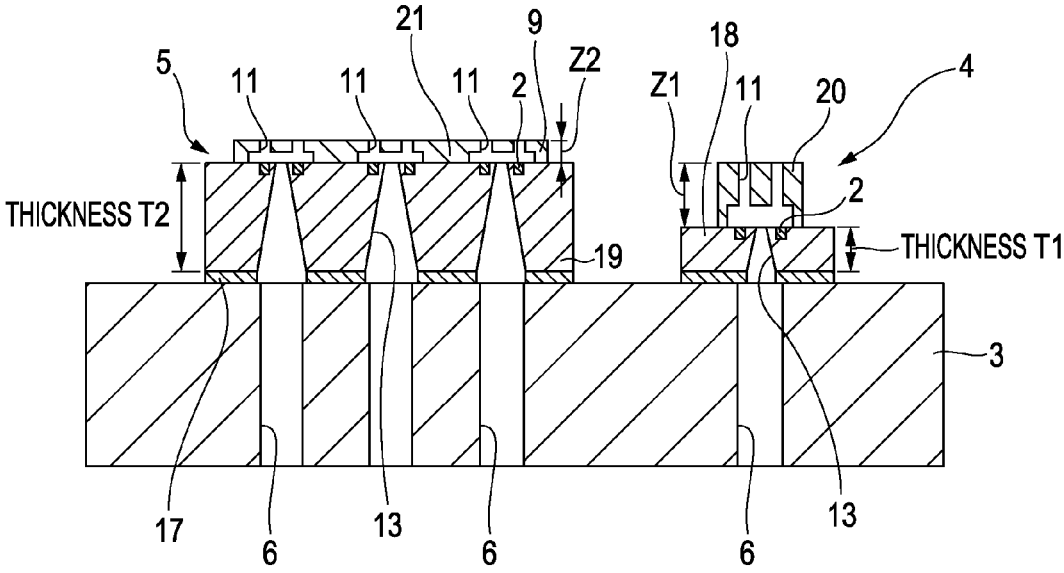
FIG. 1 illustrates a recording element board and a support member.

FIG. 1 is an expanded sectional view of first recording element board 4, second recording element board 5 and support member 3 according to an exemplary embodiment of the present invention. This FIG. 1 is equivalent to a part of the A-A' section of the liquid discharge recording head of FIG. 8. The structure of FIG. 1 is described next. In this embodiment, support member 3 is formed of alumina (AL2O3) materials having a thickness of 0.5-10 mm, for example. For example, in this embodiment, the support member 3, having a thickness of 7 mm, was used. The configuration materials of support member 3 are not limited to alumina and may be formed of a material having linear expansion approximately the same as linear expansion rate of materials of recording element boards 4 and 5, and also having a thermal conductivity rate the same as or more than that of the materials of the recording element boards 4 and 5. For example, the materials of support member 3 may be silicon (Si), aluminum nitride (AlN), zirconia, a silicon nitride, molybdenum, tungsten.

On the support member 3, the first recording element board 4, being enabled to discharge black ink, and the second recording element board 5, being enabled to discharge color ink, are formed. Liquid communication port 6 for supplying black ink is formed on the first recording element board 4, and liquid communication port 6 for supplying color inks (cyan, magenta, and yellow) is formed on the recording element board 5. A common liquid supply port 13, which is to be formed on a recording element board as a through-hole, is disposed respectively to each of the liquid communication ports 6. Also, the first recording element board 4 and the second recording element board 5 are fixed with an adhesive material in the state of being respectively positioned to the support member 3. For adhesive material 17, a material having low viscosity, having low curing temperature, requiring only a short time period for curing, having relatively high hardness after curing, and having ink resistance is preferable. For example, in the present embodiment, a heat curing adhesive material, having epoxy resin as the main component, is used, and the thickness of 50 μm or less is preferable for this adhesive material. In this embodiment, the thickness was prepared to be 25 μm.

Figure 10:
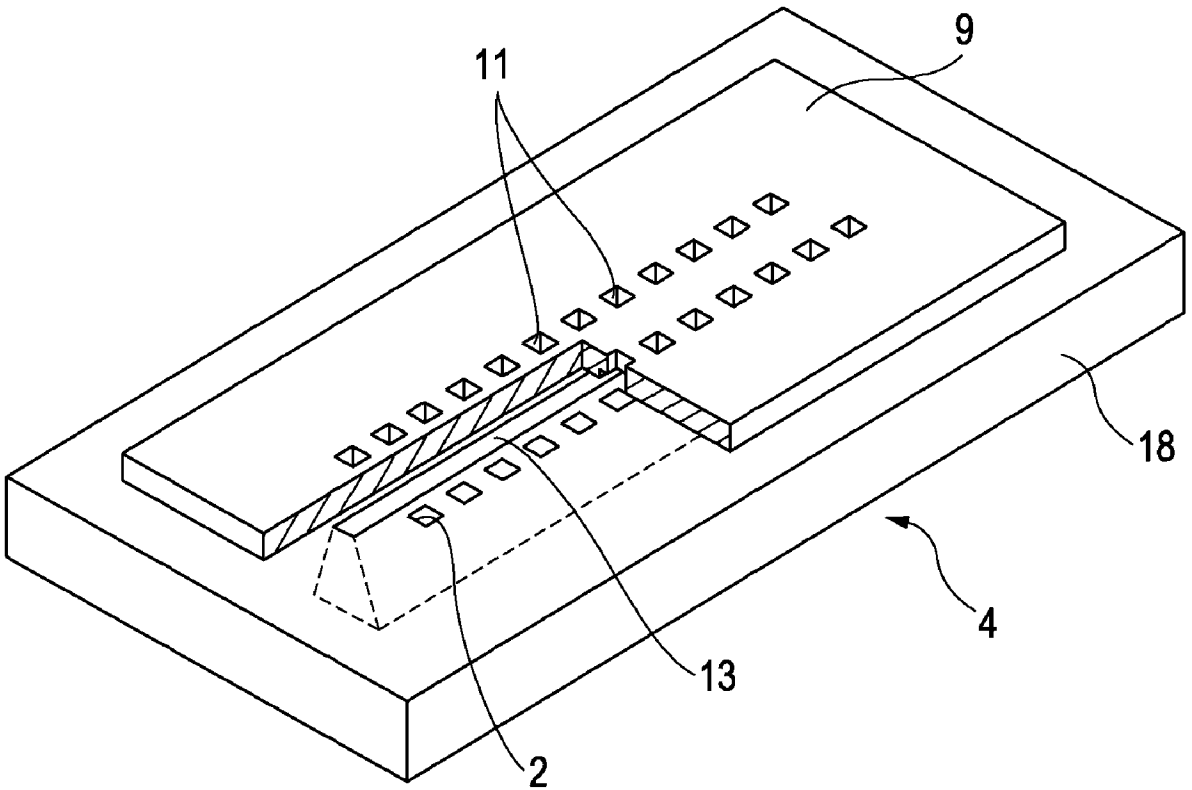
FIG. 10 illustrates a first recording element board.

An exemplary configuration of the first recording element board 4 is described next with reference to FIG. 10. The first recording element board 4 includes first base plate 18 and first flow path forming member 20. First base plate 18 is an Si base plate of thickness T1=0.5 mm-0.625 mm. On a surface of the Si base plate, energy generating element (first energy generating element) 2, which is for generating energy to be used for discharging liquid, and an electric wiring such as Al for supplying electricity to each energy generating element are formed. In this embodiment, the energy generating element includes an electrothermal transducer. In this embodiment, a thickness of 0.625 mm was used as thickness T1 of Si base plate 18. As mentioned below, the present embodiment is characterized in that the thickness of the Si base plate 18 is different from that of the second recording element board 5, and that the Si base plate 18, having a thickness of relatively thinner by more than 50 μm, is used. A plurality of ink channels and a plurality of discharge apertures (first discharge aperture) 11, corresponding to the energy generating element 2 are formed by photolithographic technology. The first recording element board 4 is for discharging black ink, and a distance Z1 from an energy element to the first discharge aperture 11 is desirable to be equal to or more than 50 μm, and equal to or less than 100 μm. In the present embodiment, the distance of Z1 is 75 μm. The ink discharge amount is 30 pl, the dot diameter is 80 μm, and the resolution is 600 dpi.

Also, on the Si base plate 18, common liquid supply port 13 for supplying ink to a plurality of ink channels is formed such that it opens to the opposite surface (rear surface).

Figure 11:
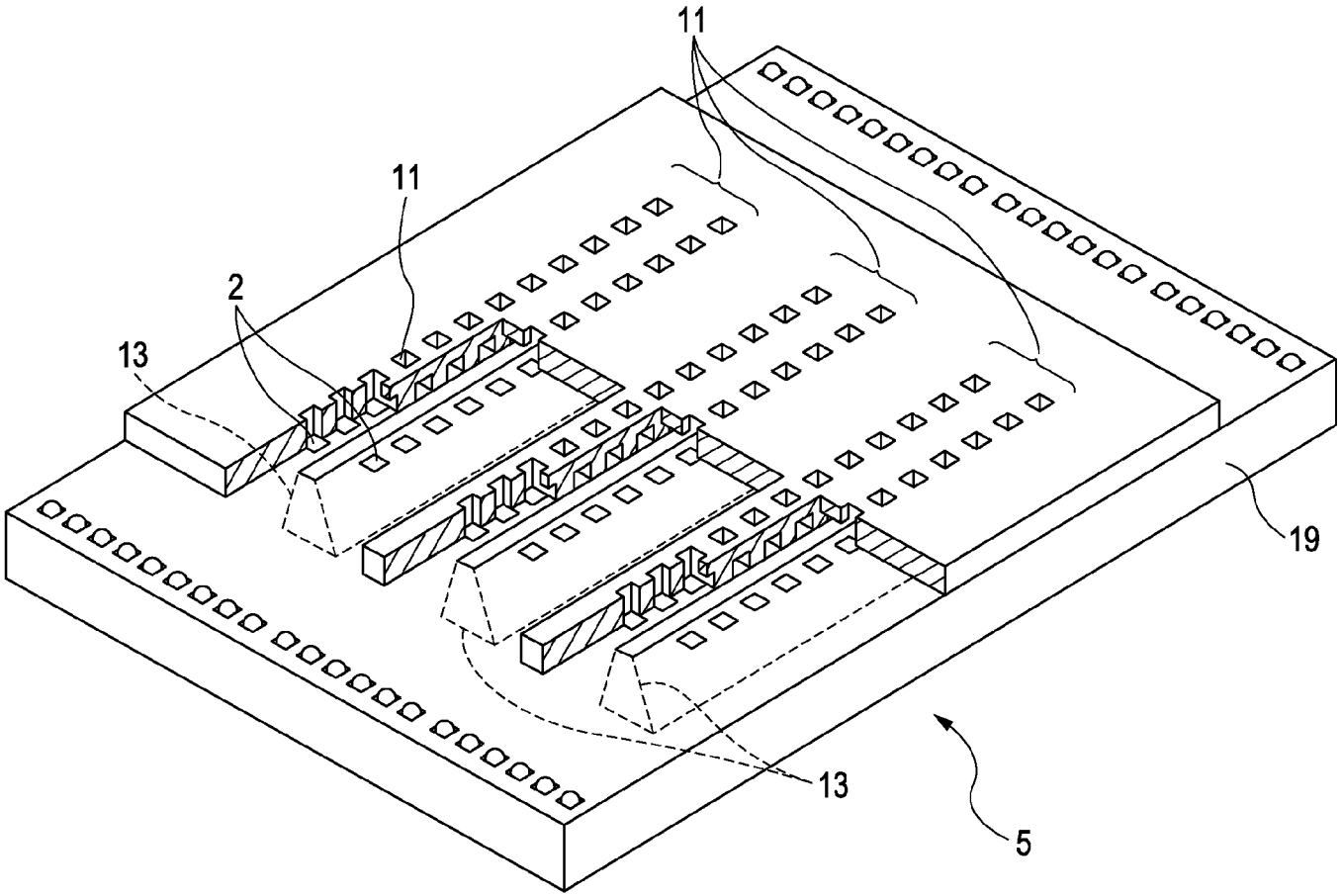
FIG. 11 illustrates a second recording element board.

Next, the configuration of the second recording element board 5 is described, referring to FIG. 11. The second recording element board 5 includes second base plate 19 and second flow path forming member 21. On the second base plate 19, a plurality of energy generating elements (a second energy generating element) 2 for discharging liquid and an electric wiring such as Al, which is for supplying electricity to each energy generating element, are formed. For thickness of the Si base plate 19, T2=0.71 mm-0.8 mm is desirable, and in the present embodiment, the thickness of 0.725 mm is used as thickness T2 of the Si base plate 19. As described below, the present embodiment is characterized by using an Si base plate, which is relatively thicker by 50 μm than that of the first recording element board, as the Si base plate 19. A plurality of ink channels and a plurality of discharge apertures (second discharge aperture) 11, corresponding to the energy generating element 2 are formed by photolithographic technology. On the second recording element board, a distance from an energy element on the second recording element board to the discharge aperture 11 is preferable to be equal to or more than 10 μm, and equal to or less than 30 μm so as to enable highly-accurate and high-quality recording, with small droplets, to be performed. In the present embodiment, the distance of Z2 is 25 μm. The ink discharge amount is set to be 5 pl and 1 pl for each color. The dot diameter of 5 pl is 40-50 μm, the dot diameter of 1 pl is 10-30 μm, and the resolution is 1200 dpi.

Further, on the Si base plate 19, common liquid supply port 13 for supplying ink to a plurality of ink channels is formed such that it opens to the opposite surface (rear surface). Three ink supply ports are formed, corresponding to discharge nozzle rows of three colors, cyan, magenta and yellow.

Figure 2:
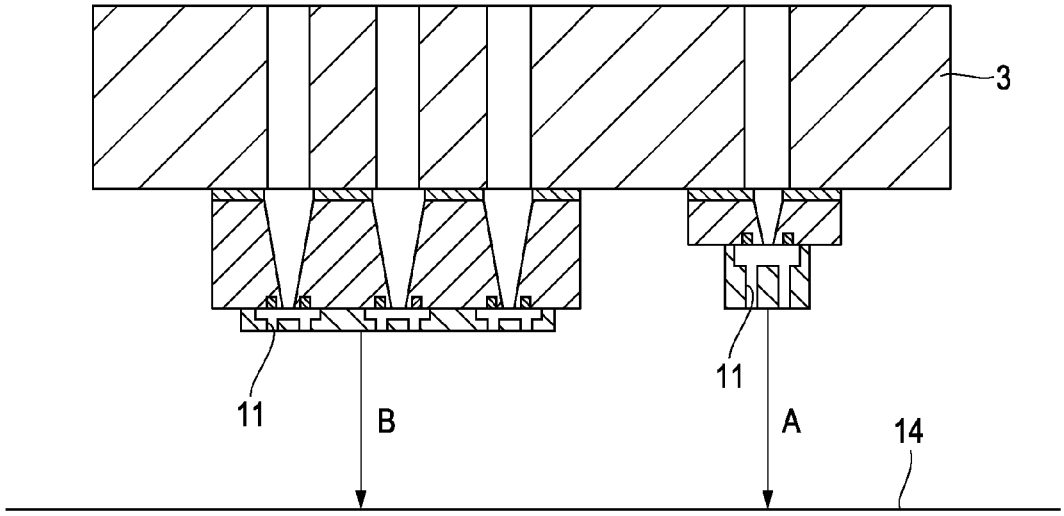
FIG. 2 illustrates a printing state by a liquid discharge recording head.

Next, a state of actual printing, using the liquid discharge recording head, is described with reference to FIG. 2. In performing printing by setting a liquid discharge recording head in an actual recording apparatus, discharge aperture 11 is disposed under support member 3, and recording surface 14 of a recording medium is disposed under the discharge aperture 11. Then, an ink droplet is discharged from the discharge aperture, the ink droplet lands on the recording surface 14 of the recording medium, and recording is performed. In performing such recording, a predetermined distance is required as the distance between the discharge aperture 11 and the surface 14 of the recording medium so as to prevent a head from being rubbed, due to undulation of a sheet surface, for example. In the present embodiment, the distance is 1.2 mm. As a nozzle structure, ink is discharged substantially perpendicularly to the recording medium 14. However, there is a case where a discharge angle may slant slightly to the recording medium due to influence such as processing tolerance of a flow path forming member and displacement of a discharge aperture in correspondence with the energy generating element 2. There is also a case where landing accuracy to a recording medium shifts due to influence of air current inside a recording apparatus.

When A denotes a distance between the discharge aperture 11 on the first recording element board 4 to the recording medium 14 (a head-to-paper distance), and B denotes a head-to-paper distance of the second recording element board 5, the relation of A>=B is satisfied with respect to the distances. Thus, the relation A=B is substantially difficult to be satisfied when this factor is further included. If the relation A<B is satisfied, then as conventionally, landing accuracy of a droplet which is discharged from a color head deteriorates. In the present invention, it is desirable to improve the landing accuracy of a droplet discharged from the second recording element board for discharging a small droplet, having large influence on forming of an image.

Therefore, in view of the above-mentioned manufacturing and installation tolerances, the relation of A>B is desirable, and A−B=0.01-0.03 mm is particularly preferable. By such a relation, a preferable discharge characteristic of color ink can be obtained since it becomes possible to adjust the head-to-paper distance of the second recording element board 5 to the above-mentioned predetermined head-to-paper distance, which has been set. In other words, the head-to-paper distance can be set based on the recording element board 5 for color ink, which is preferable. Accordingly, potential ability of the second recording element board 5 is developed, landing accuracy is improved, and image quality can be improved.

In this embodiment, the quality of the color image can be easily improved by manufacturing the first recording element board 4 and the second recording element board 5 from Si wafers of different sizes. For example, as the first recording element board 4, an Si base plate formed of 6-inch wafer which meets the SEMI standard, and as the second recording element board 5, an Si base plate formed of 8-inch wafer which meets the SEMI standard is used. The thickness of an 8-inch wafer is greater than the thickness of a 6-inch wafer. Therefore, by forming element boards of wafers having different sizes, the above-mentioned difference in thickness, which is approximately 0.1 mm, can be prepared accurately. An examination result of the present embodiment is shown below in Table 1.

TABLE 1

| Head-to Paper Distance | Printing Quality of Color Ink | Printing Quality of Black Ink |
|---|---|---|
| 1.2 mm | ◎ | ○ |
| 1.25 mm | ○ | ○ |
| 1.3 mm | ○ | ○ |
| 1.4 mm | Δ | ○ |
| 1.5 mm | X | ○ |
| 1.6 mm | X | Δ |

Criterion for Evaluation
◎ significant
○ good
Δ partially-unsteady printing
X unsteady printing With respect to the quality of a color image, significant image quality can be obtained by having a head-to-paper distance B of 1.2 mm, which is the setting minimum value. It could be verified that image quality is not deteriorated if the head-to-paper distance is equal to or less than 1.5 mm since a larger droplet is discharged when ink is black, compared to when ink is color, while head-to-paper distance A of black ink is longer than the distance of color ink.

Therefore, color printing can be improved without deteriorating the quality of black ink, compared to a conventional art, when different recording element boards are provided for a liquid discharge recording head, especially a support member, respectively for black ink and color ink, as in the present embodiment. Especially by having the thickness of the Si base plate of color ink greater than that of black ink, as in the present embodiment, the thickness of the flow path forming member of color ink can be thinner than that of the flow path forming member of black ink. By this feature, color discharge amount can be reduced, compared to black discharge amount, by a simple configuration, and at the same time, color head-to-paper distance can be reduced, compared to black head-to-paper distance. That is, as a result, the distance from a surface supporting the recording element board of the support member 3 to the second discharge aperture 11 can be made longer than the distance from a support member to the first discharge aperture 11, which is preferable.

Second Embodiment

Figure 3:
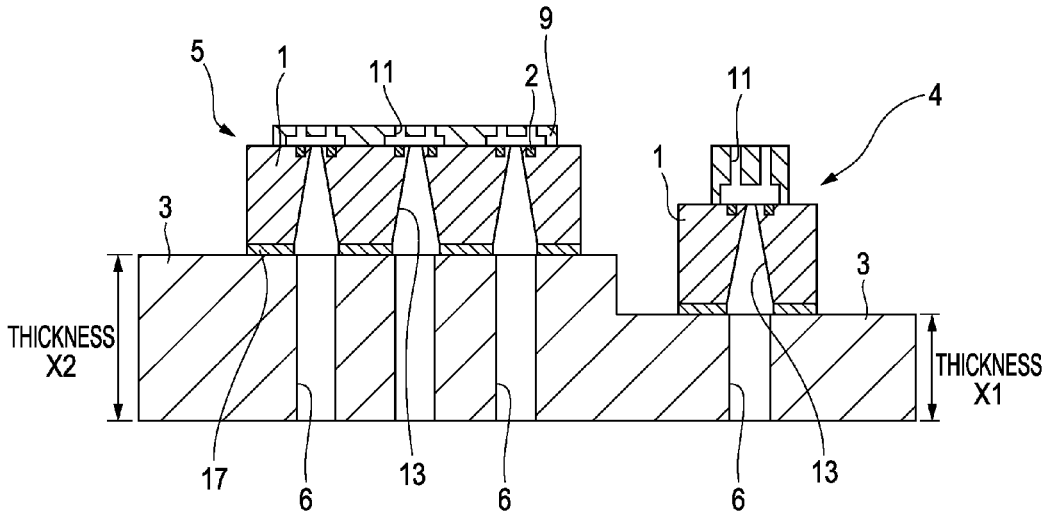
FIG. 3 illustrates a recording element board and a support member.

FIG. 3 is a sectional view of recording element board 4 or 5 and support member 3 in the second embodiment of the present invention. FIG. 3 is equivalent to a part of the A-A' section of a liquid discharge recording head of FIG. 8.

Figure 12:
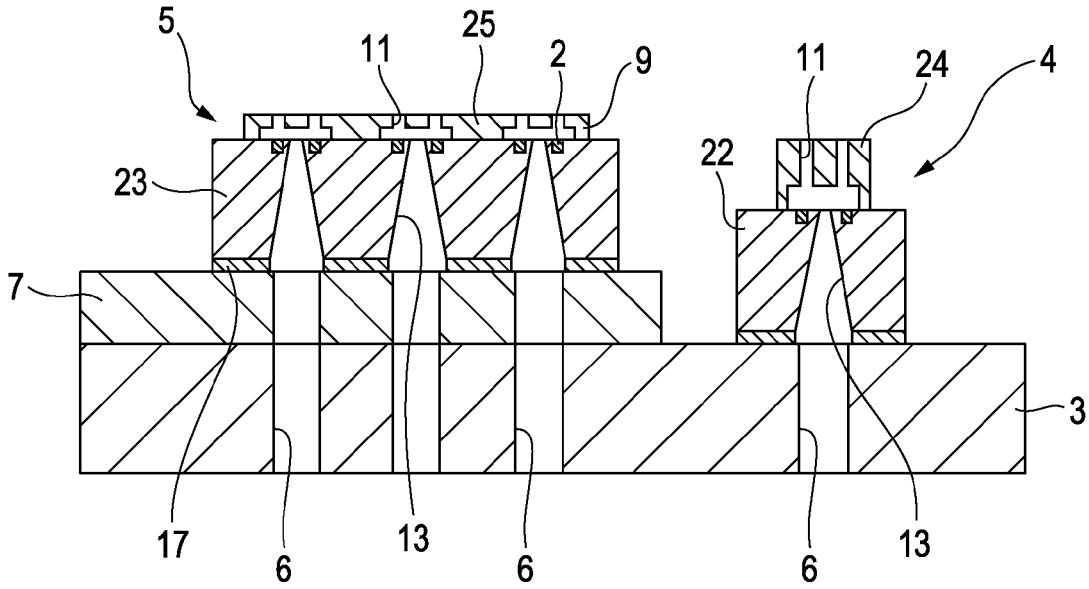
FIG. 12 illustrates a recording element board and a support member.

In FIG. 3, the support member 3 includes steps of about 0.05 mm-0.3 mm to adhesion faces of the recording element boards 4 and 5. In the present invention, X1=6.8 mm in a relatively-thin portion of the support member 3, where the recording element board 4 is adhered, and X2=7 mm in a relatively-thick portion of the support member 3, where the recording element board 5 is adhered. As a result, the formula of X2−X1>=0.05 mm is satisfied. As shown in FIG. 12, this step may be formed of materials such as plate 7 for offset. The materials of the support member 3 and the plate for offset may be formed of alumina (AL2O3) materials. The materials of the support member 3 and the plate for offset is not limited to alumina, for example, the material but can be silicon (Si), aluminum nitride (AlN), zirconia, a silicon nitride, molybdenum, or tungsten.

In the support member 3, liquid communication port 6 for supplying black ink to the first recording element board 4 and liquid communication port 6 for supplying cyan, magenta and yellow ink are formed. As shown in FIG. 12, a liquid communication port is formed using plate 7 for offset. A common liquid supply port 13 of the recording element board corresponds to the support member 3, or the plate 7 for offset corresponds to the liquid communication port 6, respectively. The first recording element board 4 and the second recording element board 5 are fixed with an adhesive material in the state of being respectively positioned to the support member and the plate for offset accurately. For this adhesion, a material having low viscosity, whose curing temperature is low, whose curing time is short, having relatively high hardness after curing and having ink resistance is preferable. For example, in the present embodiment, the adhesive material is desired to be a heat curing adhesive material having epoxy resin as its main component, and its thickness is desired to be 50 μm or less. The thickness is 25 μm in the present embodiment.

Next, the configuration of the first recording element board 4 and the second recording element board 5 is described with reference to FIGS. 10 and 11. In the present embodiment, the thickness of Si base plate 22 of the first recording element board 4 is 0.71 mm-0.8 mm, and the thickness of Si base plate 23 of the second recording element board 5 is 0.71 mm-0.8 mm, which is the same as the Si base plate 22. The thickness of flow path forming member 24 of the first recording element board 4 and that of flow path forming member 25 of the second recording element board 5 are prepared to be the same as the first embodiment.

Figure 4:
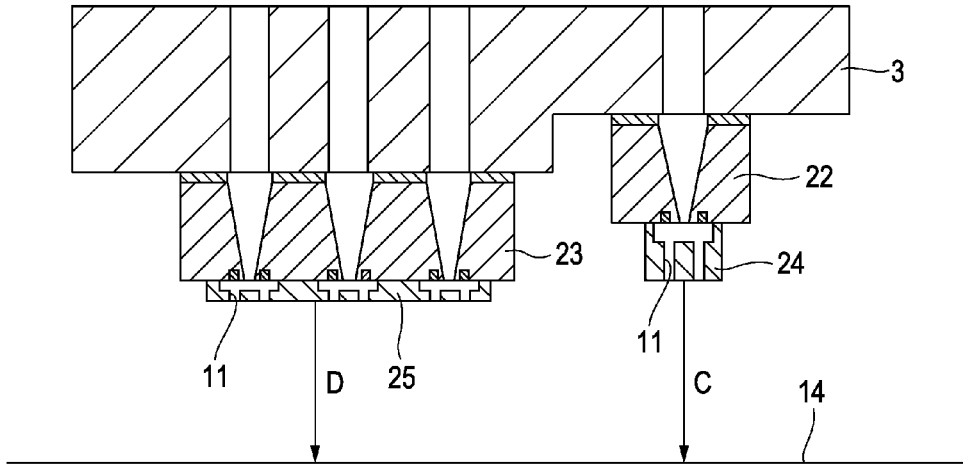
FIG. 4 illustrates a printing state by a liquid discharge recording head.

Next, a state of actual printing is described, using the liquid discharge recording head, as shown in FIG. 4. In performing printing by setting a liquid discharge recording head in an actual recording apparatus, discharge aperture 11 is disposed under support member 3, and recording surface 14 of a recording medium is disposed under the discharge aperture 11 in the recording element boards 4 and 5. Then, an ink droplet is discharged from the discharge aperture, the ink droplet lands on the recording surface 14 of the recording medium, and recording is performed. For the present embodiment, the distance between the discharge aperture 11 and the surface 14 of the recording medium is 1.2 mm. When C denotes a distance between the discharge aperture 11 on the first recording element board 4 to the recording medium 14 (a head-to-paper distance), and D denotes a head-to-paper distance of the second recording element board 5, the relation of C>=D is preferable. C−D=0.01-0.03 mm is preferable when processing tolerance is considered. By the above-mentioned configuration, it becomes possible to set the discharge aperture 11 of the second recording element board 5 as a reference for the minimum head-to-paper distance for preventing a recording medium and a head from interfering with each other. As a result, desirable characteristics of color ink can be obtained. Accordingly, potential ability of the second recording element board 5 is developed, landing accuracy is improved, and image quality can be improved significantly. The present embodiment is characterized in that the quality of the color image can be improved only by having the thickness of the support member 3, where the second recording element board is adhered, greater by 0.05 mm or more than the thickness of the support member 3, where the first recording element board is adhered. The advantage of the present embodiment is that the quality of color image can be significantly improved by only adding processing of the step of the support member, without changing the recording element board. Also, adjusting the height with different members, as in FIG. 12, is desirable to the effect that processing of the support member is unnecessary. Also, according to the present embodiment, the height adjustment can be accurately performed.

Third Embodiment

Figure 5:
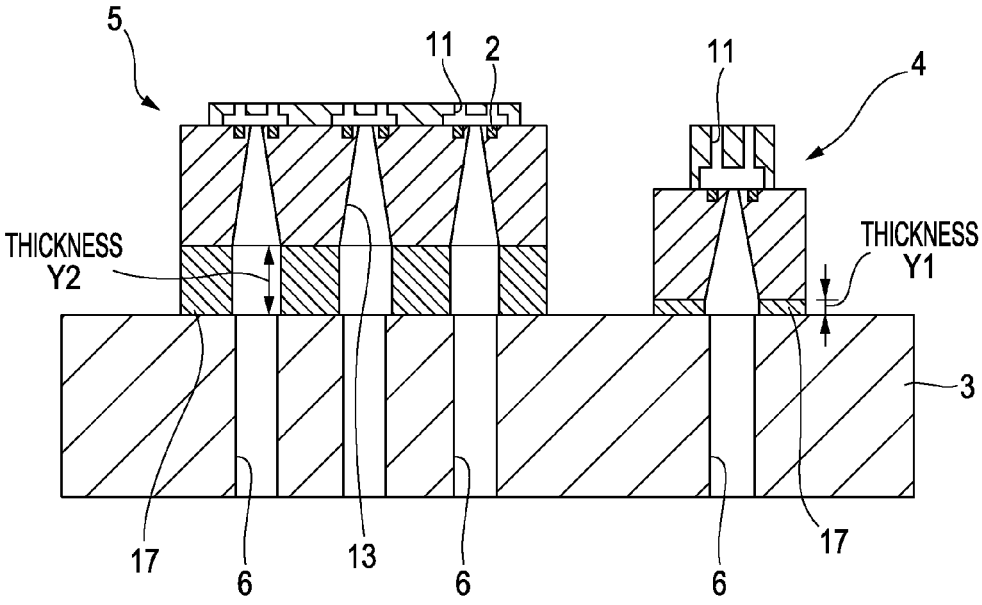
FIG. 5 illustrates a recording element board and a support member.
Figure 6:
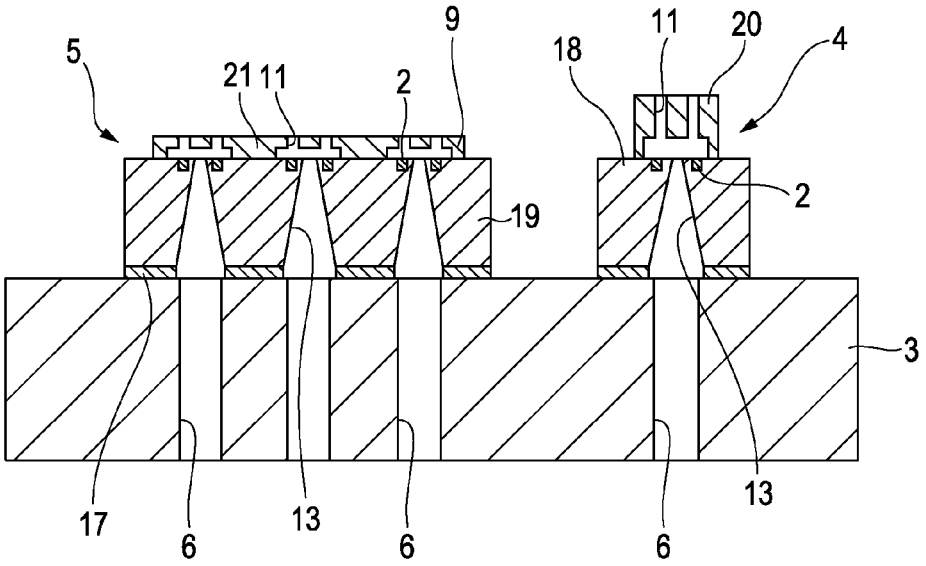
FIG. 6 illustrates a conventional recording element board and a support member.
Figure 7:
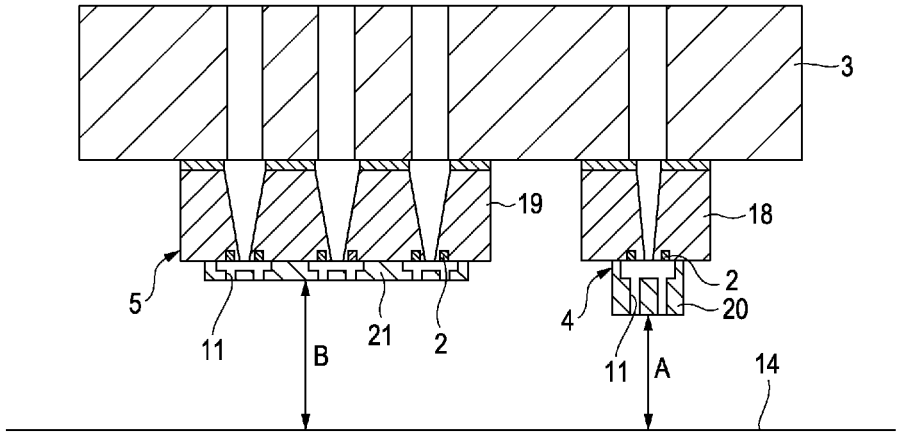
FIG. 7 illustrates a conventional printing state by a liquid discharge recording head.

FIG. 5 is an expanded sectional view of the recording element board and the support member in the third embodiment of the present invention. FIG. 5 is equivalent to a part of the A-A' section of a liquid discharge recording head shown in FIG. 8. The difference between the first and the second embodiments is that the head-to-paper distances are made different between the first and the second recording element boards by changing the thickness of the adhesive layers for adhesion of the support member and the recording element board. When Y1 denotes a thickness of the adhesive material layer of the first recording element board 4, and Y2 denotes a thickness of the adhesive material layer of the second recording element board 5, the relation of Y2−Y1>=0.05 mm is satisfied. An effect similar to that of the first and second embodiment is provided by satisfying such an expression of relations. The present embodiment is characterized in that the quality of the color image can be improved only by having the thickness of the adhesive layer for adhesion of the second recording element board greater by 0.05 mm or more than the thickness of the adhesive layer for adhesion of the first recording element board.

The present invention can be widely applied to a liquid discharge recording head to be mounted in an ink jet recording apparatus such as an ink jet printer.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. A liquid discharge recording head comprising:

a first recording element board including a first discharge aperture for discharging liquid;

a second recording element board including a second discharge aperture, the second discharge aperture being smaller than the first discharge aperture; and a support member including a face, and supporting the first recording element board and the second recording element board, wherein a distance from the face of the support member to the second discharge aperture is longer than a distance from the face of the support member to the first discharge aperture.

2. The liquid discharge recording head according to claim 1, wherein the liquid discharge recording head performs recording by discharging liquid to a medium to be recorded, and wherein a distance between the second discharge aperture and the medium to be recorded is shorter than a distance between the first discharge aperture and the medium to be recorded.

3. The liquid discharge recording head according to claim 1, wherein the first recording element board includes a first base plate having a first energy generating element for generating energy to be used for discharging liquid and a first flow path forming member having the first discharge aperture and a flow path, and wherein the second recording element board includes a second base plate having a second energy generating element for generating energy to be used for discharging liquid and a second flow path forming member having the second discharge aperture and a flow path.

4. The liquid discharge recording head according to claim 3, wherein a thickness of the second base plate is greater than a thickness of the first base plate.

5. The liquid discharge recording head according to claim 3, wherein a thickness of the first flow path forming member is greater than a thickness of the second flow path forming member.

6. The liquid discharge recording head according to claim 1, wherein a thickness of a portion supporting the first recording element board is smaller than a thickness of a portion supporting the second recording element board in the support member.

7. The liquid discharge recording head according to claim 6, wherein the thickness of the first base plate and the thickness of the second base plate are the same.

8. The liquid discharge recording head according to claim 1, wherein a thickness of an adhesive material between the support member and the first recording element board is smaller than a thickness of an adhesive member between the support member and the second recording element board.

9. The liquid discharge recording head according to claim 1, wherein the first discharge aperture is enabled to discharge black ink, and wherein the second discharge aperture is enabled to discharge color ink, the discharge amount of the color ink being smaller than the discharge amount of the black ink.

* * * * *